United States Patent [19]

Joseph

[11] Patent Number: 4,867,722

[45] Date of Patent: Sep. 19, 1989

[54] CONVERTIBLE WATER SKI HANDLE

[76] Inventor: Charles M. Joseph, 26766 N. Claudette, Canyon Country, Calif. 91351

[21] Appl. No.: 286,938

[22] Filed: Dec. 20, 1988

[51] Int. Cl.[4] ..... A63C 15/06

[52] U.S. Cl. ..... 441/69; 16/111 R; 16/114 R; 114/253

[58] Field of Search ..... 16/114 R, 110 R, 111 R; 114/253; 441/69

[56] References Cited

U.S. PATENT DOCUMENTS

| | | | |
|---|---|---|---|
| 3,092,068 | 6/1963 | Brownson | 16/110 R |
| 3,122,609 | 2/1964 | Moore | 114/253 |
| 3,196,825 | 7/1965 | Spurlock | 441/69 |
| 3,219,007 | 11/1965 | Kiefer | 441/69 |
| 4,392,833 | 7/1983 | Hayden | 114/253 |

*Primary Examiner*—Nicholas P. Godici
*Assistant Examiner*—Carmine Cuda
*Attorney, Agent, or Firm*—Roger A. Marrs

[57] ABSTRACT

A water ski tow rope is disclosed herein convertible between a single handle position and a two-handle position wherein the end of a tow rope terminates a pair of lines, each line having a ring and hook, said hooks adapted to be either snapped together into a single tow loop for single-handed use or snapped to the respective rings to define a pair of tow loops for double or two-handed use. A cushioned handle is divided into a pair of segments so that when opposing segment ends are joined, the single-handed position is defined and, when separated, the two-handed position is defined.

1 Claim, 1 Drawing Sheet

FIG. 1.
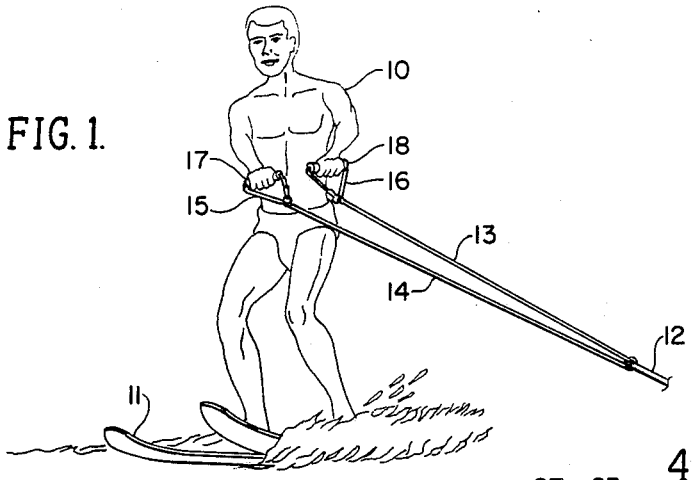
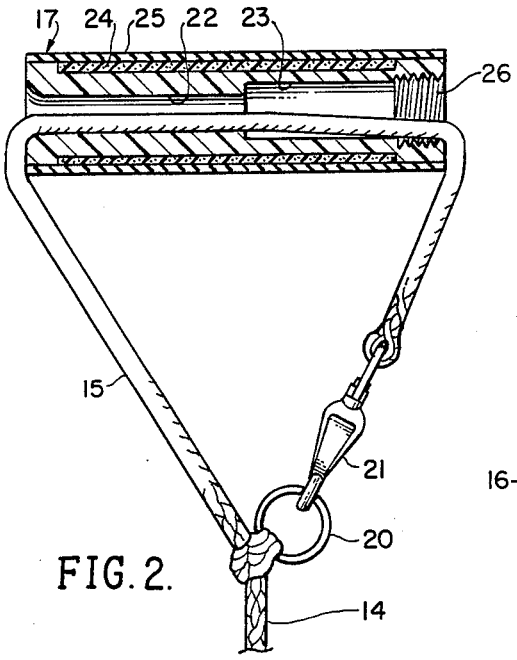
FIG. 2.
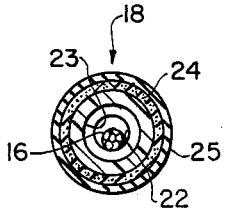
FIG. 4.
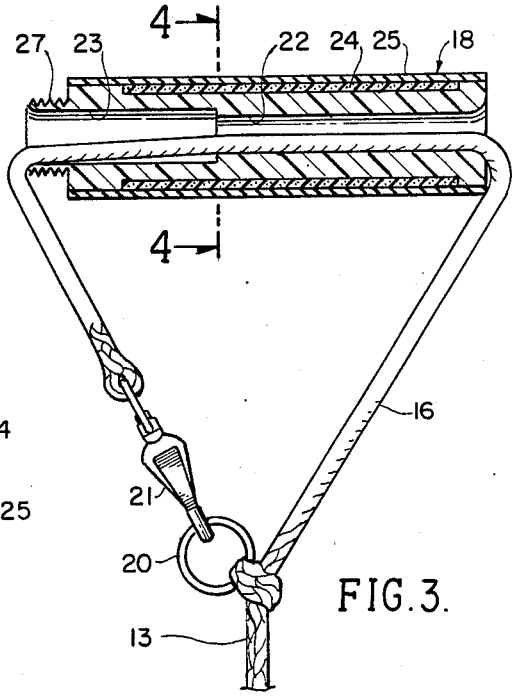
FIG. 3.
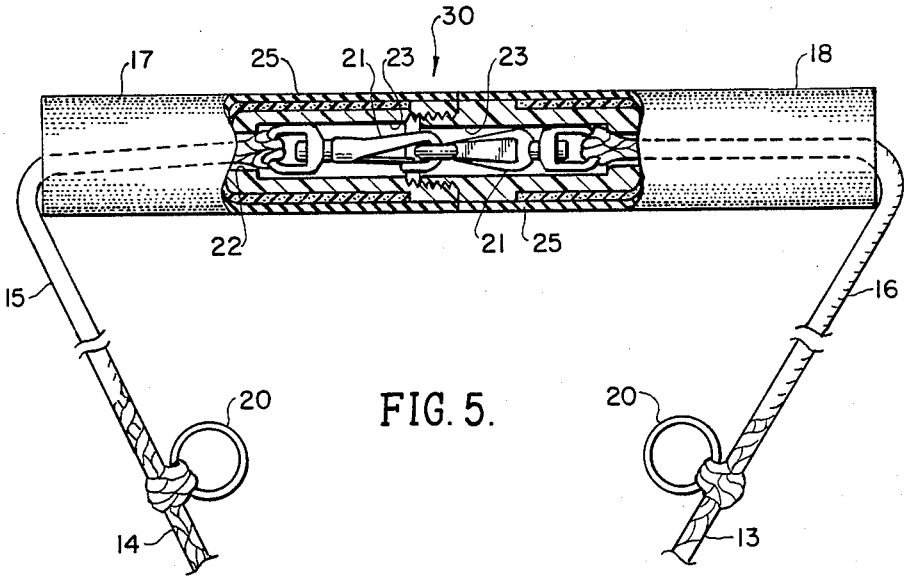
FIG. 5.

CONVERTIBLE WATER SKI HANDLE

BACKGROUND OF THE INVENTION

1. Field of the Invention

The present invention relates to the field of water ski towing devices, and more particularly, to a novel water ski handle and tow rope having the ability to be converted between a single-handed configuration or arrangement and a double or two-handed handle arrangement at the option or election of the user.

2. Brief Description of the Prior Art

In the past, it has been the conventional practice in performing a water skiing procedure for the skier to grasp the end of a tow rope with both hands via a suitable handle. In normal practice, the tow rope is bifurcated into a pair of lined segments which terminate in a pair of handles respectively, intended to be grasped by the hands of the user. On occasion, the user may wish to employ a single handle in order to perform special maneuvers or the like.

Difficulties and problems have been encountered when employing conventional water ski tow rope equipment which stem largely from the fact that it is difficult for the user to convert the handle from a two-handed arrangement to a single-handed arrangement. Usually, the water skier will change tow ropes in order to utilize either a single or double handle arrangement. In some instances, when the user desires a single handle, the second line segment or portion of a bifurcated tow rope may be tied back or otherwise secured out of the way so only a single handle is available for skier use. Both of these solutions are awkward,, require extra equipment or cumbersome tie-back arrangements.

Therefore, a long-standing need has existed to provide a novel water ski tow rope arrangement employing a handle means that may be rapidly converted between a single handle and a double handle at the convenience and election of the user.

SUMMARY OF THE INVENTION

Accordingly, the above problems and difficulties are obviated by the present invention which provides a novel water ski rope arrangement having a handle means convertible between a single and a double arrangement, utilizing a ski rope having a bifurcated or segmented towing portion with the handle means at the terminating ends of each portion. In one form of the invention, the bifurcated line portion of the tow rope terminates in secured loops spaced a short distance from the terminating end of each line and which further includes a hook portion at the terminating end of each line. Slidably situated between the loop and the hook is a handle grip. The handle grips on each of the tow rope line segments are positionable between selected configurations determined by attachment of the respective line segment hooks. In a first configuration, the hooks are coupled with the loops so that a pair of handle grips is available for grasping by the user. In a second configuration, the hooks are coupled to each other, followed by detachably connecting opposing ends of the handle grips together so that the hooks are covered and the grips comprise a single elongated handle. Thereby, either a single or double handled arrangement is provided to the skier while using a single tow line having a bifurcated line segment handle means.

Therefore, it is among the primary objects of the present invention to provide a novel water ski tow rope arrangement having means for selectively disposing a handle means between a one and a two-handed handle-grasping position or configuration.

Another object of the present invention is to provide novel means whereby a water skier can rapidly convert the handle-grasping means of a bifurcated tow rope between a single and a double-handed position or configuration.

Another object of the present invention is to provide a means for rapidly converting a handle means between a double and a single-handed configuration at the option or selection of the water-skiing user.

Yet another object of the present invention is to provide an inexpensive means for permitting a water skier to convert the handles attached to the end of a tow rope between a single-handed position and a double-handed position with ease and economy.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a diagrammatic illustration of a water skier being towed at the end of a tow rope, grasping onto the handle means of the present invention;

FIGS. 2 and 3 illustrate the handle means shown in FIG. 1 as illustrated in longitudinal cross-sectional views whereby the handle means is selectively separated into a two-handed usage by providing a pair of handle grips in separated fashion;

FIG. 4 is a transverse cross-sectional view of the handle grip shown in FIG. 3 as taken in the direction of arrows 4—4 thereof; and FIG. 5 is a top plan view of the convertible handle means shown in FIGS. 2 and 3 arranged in a second configuration wherein the handle grips are joined together to form a single handle at the end of a tow rope shown in FIG. 1.

DESCRIPTION OF THE PREFERRED EMBODIMENT

Referring to FIG. 1, a water skier is illustrated by numeral 10 as being carried on a pair of ski 11 and as being towed by a tow line 12 which terminates in a pair of bifurcated tow line segments or portions 13 and 14. The ends of the tow line portions 13 and 14 are arranged in closed loops 15 and 16 which are passed through a pair of handle grips 17 and 18 about which the user's hands are placed. In this configuration, the handle grips 17 and 18 are double so that both of the water skier's hands can be placed on the respective grips. Thus, the skier 10 is utilizing the handle grip in a two-handed arrangement. In this configuration, the user may perform a variety of maneuvers and each of the respective tow line portions 13 and 14 can be manipulated by the respective hands of the water skier 10 in unison or independent of each other.

Referring now in detail to FIGS. 2 and 3, the convertible handle means of the present invention is illustrated in the two-handed mode of usage as illustrated by the water skier in FIG. 1. The tow rope segment or portion 14 includes a ring or eyelet 20 fixedly secured at a location away from the terminating end of the line 14. The extreme end of the line is secured to a snap hook 21 which is releasably connected to the ring or eyelet 20. Therefore, the loop 15 is defined and passes through an open-ended passageway 22 formed in the handle 17. The passageway 22 includes an enlarged diameter portion 23 which is adapted to accept the presence of the snap hook 21 when the handle means has been converted to the single handle configuration 30 as shown in FIG. 5 cross-sectional view of handle grip 18 with handle grip layers 24 and 25 is shown in FIG. 4.

It can be seen that the construction of the handle means 17 and 18 is identical except for the provision of the detachable coupling taking the form of the threaded projection 27 and threaded receptacle 26. The passageways 22/23 on each of the handles are coaxially disposed and the ends opening exteriorly of each of the handle portions or grips include a chamfered edge so as to permit turning of the line for exiting the open ends of the passageway. In this manner, chafing is avoided.

Therefore, it can be seen that the novel handle means of the present invention is readily convertible from a double handle, as shown in FIGS. 2 and 3, to a single handle, as shown in FIG. 5. Convertibility is achieved by detachably connecting the snap fastener 21 with either the ring or eyelet 20 in the two-handle configuration or coupling the snap fasteners together, as shown in FIG. 5, for the single handle configuration. The option of a single or double handle is available to the user preparatory to a water skiing procedure, or the user may even change the handle configuration while engaging in a skiing procedure.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A convertible water ski handle comprising:

an elongated, cylindrical handle having an open-ended bore defined between its opposite ends said handle being composed of a pair of handle grips detachably connected together in end-to-end relationship;

a tow rope trained through said handle bore having line portions turned over said handle ends to provide a closed loop in a first assembly state;

each of said tow rope line portions having an end terminating in a releasable fastener and each line portion further having a ring in fixed spaced-apart relationship with respect to said end; and said fasteners being adapted to be coupled to each other within said handle bore in said first assembly state and being adapted to be coupled to their respective line portion rings externally of said handle with each line portion being trained through its respective handle grips when said handle grips are separated to provide a pair of closed loops in a second assembly state.

* * * * *